US011536440B2

(12) United States Patent
Jiang

(10) Patent No.: US 11,536,440 B2
(45) Date of Patent: Dec. 27, 2022

(54) BEAM SHADING DEVICE CAPABLE OF ACCURATELY POSITIONING AND STAGE LIGHT HAVING THE SAME

(71) Applicant: Guangzhou Haoyang Electronic Co., Ltd., Guangdong (CN)

(72) Inventor: Weikai Jiang, Guangdong (CN)

(73) Assignee: GUANGZHOU HAO YANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/514,605

(22) Filed: Oct. 29, 2021

(65) Prior Publication Data

US 2022/0049839 A1 Feb. 17, 2022

Related U.S. Application Data

(63) Continuation of application No. PCT/CN2021/074040, filed on Jan. 28, 2021.

(30) Foreign Application Priority Data

Jul. 31, 2020 (CN) ..... 202010761436.8

(51) Int. Cl.
*F21V 14/08* (2006.01)
*F21V 19/02* (2006.01)
(Continued)

(52) U.S. Cl.
CPC ..... *F21V 14/08* (2013.01); *F21V 19/02* (2013.01); *F21V 11/08* (2013.01); *F21V 11/10* (2013.01);
(Continued)

(58) Field of Classification Search
CPC ..... F21V 11/06; F21V 11/065; F21V 11/10; F21V 11/12; F21V 11/18; F21V 11/186;
(Continued)

(56) References Cited

U.S. PATENT DOCUMENTS 10,018,329 B1 7/2018 Belliveau
10,845,030 B1 * 11/2020 Tornyai ..... F21V 7/041
(Continued)

FOREIGN PATENT DOCUMENTS

CN 102679274 A 9/2012
CN 108506880 A * 9/2018
(Continued)

OTHER PUBLICATIONS

Machine Translation of CN102679274A Retrieved from Espacenet. (Year: 2022).*

*Primary Examiner* — Colin J Cattanach
(74) *Attorney, Agent, or Firm* — Muncy, Geissler, Olds & Lowe, P.C.

(57) ABSTRACT

A beam shading device capable of accurately positioning includes a substrate, a plurality of shading blades mounted on the substrate, and driving mechanisms for driving the shading blades to move. The substrate is provided with a first light-passing hole through which beams pass, the plurality of shading blades are arranged around the periphery of the first light-passing hole, and the driving mechanisms drive the shading blades to move back and forth between blocking and opening the first light-passing hole. Each shading blade is configured with at least two driving mechanisms, and each driving mechanism includes a driving gear and a driving plate. The driving plate is hinged with the shading blade, and the driving plate is provided with a rack that meshes with the driving gear.

20 Claims, 2 Drawing Sheets

(51) Int. Cl.

| | |
|---|---|
| ***F21W 131/406*** | (2006.01) |
| ***F21V 11/18*** | (2006.01) |
| ***F21V 11/10*** | (2006.01) |
| ***F21V 11/08*** | (2006.01) |
| ***F21V 11/16*** | (2006.01) |
| ***F21V 11/12*** | (2006.01) |

(52) U.S. Cl.
CPC ..... *F21V 11/12* (2013.01); *F21V 11/16* (2013.01); *F21V 11/18* (2013.01); *F21V 11/183* (2013.01); *F21V 11/186* (2013.01); *F21W 2131/406* (2013.01)

(58) Field of Classification Search
CPC ..... F21V 14/00; F21V 14/006; F21V 14/08; F21V 14/085; F21W 2131/406
See application file for complete search history.

(56) References Cited

U.S. PATENT DOCUMENTS

| | | | | |
|---|---|---|---|---|
| 2003/0048640 | A1* | 3/2003 | Reinert | F21V 11/18 362/284 |
| 2004/0017685 | A1* | 1/2004 | Dedoro | F21V 14/08 362/268 |
| 2015/0109797 | A1* | 4/2015 | Urik | F21V 11/18 362/321 |

FOREIGN PATENT DOCUMENTS

| | | | | | |
|---|---|---|---|---|---|
| CN | 208919799 | U | | 5/2019 | |
| CN | 110486693 | A | * | 11/2019 | F21V 1/08 |
| CN | 210485560 | U | | 5/2020 | |
| CN | 210921226 | U | | 7/2020 | |
| CN | 111853684 | A | | 10/2020 | |
| CN | 212644469 | U | | 3/2021 | |
| FR | 2843628 | A1 | * | 2/2004 | F21V 11/18 |
| GB | 2268888 | A | * | 1/1994 | F21S 10/007 |
| JP | 3209301 | U | | 3/2017 | |
| WO | WO-2015057235 | A1 | * | 4/2015 | F21V 11/186 |

* cited by examiner

BEAM SHADING DEVICE CAPABLE OF ACCURATELY POSITIONING AND STAGE LIGHT HAVING THE SAME

CROSS REFERENCE TO RELATED APPLICATIONS

The present application is a continuation of International Application No. PCT/CN2021/074040, filed on Jan. 28, 2021, which claims priorities from Chinese Patent Application No. 202010761436.8 filed on Jul. 31, 2020, all of which are hereby incorporated herein by reference.

TECHNICAL FIELD

The present invention relates to the technical field of stage lights, and more particularly, relates to a beam shading device capable of accurately positioning and a stage light having the same.

BACKGROUND

With the continuous development of stage light technology, the requirements for diversification of stage effects are getting higher and higher. In order to meet the needs of different application occasions, a shading device located between the light source and the light-emitting lens is usually used to shade the beam, so that the light spot projected by the stage light presents various shapes. The shading device includes a plurality of shading blades. The shading blades are driven to move to block and intercept part of the beam by a driving mechanism to form a preset imaging shape. The existing driving mechanisms are mostly of multi-stage transmission of connecting rods and rocker arms or synchronous belt transmission. However, since there is loose fit for connecting rods and rocker arms after multi-stage transmission and there is also empty space due to the soft contact between the belt and the gear, when the shading blade is reset, it cannot be completely returned to the initial position originally set. During the shading process of the shading blade, the shading accuracy will also be affected, which in turn affects the stage effect.

SUMMARY

The present invention aims to overcome at least one of the above-mentioned drawbacks of the prior art, and provides a beam shading device capable of accurately positioning. The shading blade is driven by a driving mechanism which is driven by a driving gear and a rack, and the position of the shading blade can be accurately controlled during the shading process, so that the shading accuracy of the shading blade can be effectively improved during the shading process, and the consistency and accuracy of the shading pattern can be ensured.

According to the present invention, the beam shading device capable of accurately positioning includes a substrate, a plurality of shading blades mounted on the substrate, and driving mechanisms for driving the shading blades to move. The substrate is provided with a first light-passing hole through which beams pass. The plurality of shading blades are arranged around the periphery of the first light-passing hole. The driving mechanisms drive the shading blades to move back and forth to block and open the first light-passing hole. Each of the shading blades is configured with at least two driving mechanisms, and each of the driving mechanisms includes a driving gear and a driving plate. The driving plate is hinged with the shading blade, and the driving plate is provided with a rack that meshes with the driving gear.

In the present invention, each shading blade of the beam shading device is configured with at least two driving mechanisms, and each driving mechanism can independently drive the shading blade to move back and forth to block and open the first light-passing hole. When two driving mechanisms of each shading blade maintain a consistent state of motion, the driving mechanisms drive the shading blade to perform a translation movement. However, when the motion states of all driving mechanisms are not the same, since the driving plate is movably connected to the shading blade, the driving mechanisms can drive the corresponding shading blade to perform a swing movement. The specific work process is as follows. The driving gear rotates to drive the driving plate to move, thereby driving the shading blade to perform a translation and/or swing movement, so that the shading blade reaches a preset position, and the beam is shaded into a preset shape. The beam shading device uses driving mechanisms driving by a driving gear and a rack to drive the shading blade, and the driving plate provided with the rack is directly hinged with the shading blade, without using transmission parts such as a connecting rod to indirectly drive the effect piece. Such configuration reduces the problem of empty space caused by multi-stage transmission, and the position of the shading blade can be accurately controlled during the shading process, the shading accuracy of the shading blade thus can be effectively improved during the shading process, and the consistency and accuracy of the shading pattern can be ensured.

According to the present invention, the driving plate is provided with a linear first guide groove opened towards the direction of the first light-passing hole. The substrate is provided with a first sliding post adapted to the first guide groove, and the first sliding post penetrates the first guide groove and is slidable in the first guide groove. On one hand, the first sliding post plays a role of supporting the driving plate, and on the other hand, it can also guide the driving plate to move along the first guide groove.

According to the present invention, the rack is arranged in parallel with the first guide groove. The direction of the first guide groove is kept consistent with the direction of the rack, which ensures that the driving plate can be continuously driven to move without changing the position of the driving gear during the movement of the driving plate.

both ends of the first guide groove bend and extend towards the direction of the rack. In two of the driving plates provided on the same shading blade, when one driving plate moves towards the first light-passing hole and the other driving plate does not move towards the first light-passing hole, and the first sliding post is located at an end position of the first guide groove, the driving plate that does not move will be caused to rotate around its own first sliding post due to the joint action of the driving plate that moves. The end of the first guide groove bends and extends towards the direction of the rack, leaving a smooth rotation space for the first sliding post of the driving plate that does not move, and the corresponding shading blade will not be suddenly jammed.

The driving gear is made of metal, and the rack is made of rubber. The driving gear and the rack are made of two materials of metal and rubber. Compared with the case where both use metal materials, the use of two materials in which one is soft and the other is hard can reduce the noise generated by the movement of the two. The rubber material has a high elasticity with reversible deformation. What's more, when squeezed by the driving gear, it can be elastically deformed, so as to adaptively adjust the meshing tightness of the driving gear and the rack and adjust the fitting state of the driving gear and the rack to the best to ensure the shading accuracy of the shading blade during the shading process.

According to the present invention, the driving plate is provided with a plurality of metal tooth tips on the side on which the rack is provided at the end close to the shading blade, which mesh with the driving gear. When the driving gear meshes with the metal tooth tips, the shading blade is in the reset state. The shading blade will return to the reset state several times during the shading process. Compared to tooth tips made of rubber, the provision of metal tooth tips at the end of the driving plate close to the shading blade can reduce wear and increase the service life of the driving plate.

Two the driving plates of each shading blade are arranged on a side of the shading blade far away from the first light-passing hole, and the vertical distance between the center of the first light-passing hole and each of the driving plates is equal. That is, each of the shading blades is configured with at least two driving mechanisms, and two symmetrical sets of the driving mechanisms jointly drive the shading blade to move back and forth to block and open the first light-passing hole, so that the movement of the shading blade will be more stable.

According to the present invention, a first panel and a second panel that are a stacked arrangement are fixed on the substrate, and both the first panel and the second panel are provided with a second light-passing hole corresponding to the first light-passing hole. A plurality of the shading blades are provided between the first panel and the second panel. The first panel and the second panel are configured to protect the shading blades, and prevent the shading blades from being interfered by other elements during the movement process and being jammed.

Both the first panel and the second panel are provided with a second guide groove corresponding to each of the shading blades, and the second guide groove is arranged along the radial direction of the first light-passing hole. Each of the shading blades is provided with a second sliding post slidingly fitted with the second guide groove. The second sliding post can slide in the second guide groove, so that the entire shading blade does not deviate, and the shading blade is guided to move towards or away from the second light-passing hole only. It should be noted that the shading blade may be fitted with the second guide groove of the first panel or the second panel according to whether it is close to the first panel or the second panel.

According to the present invention, screw holes used for fixing the driving motor on the substrate are elongated through holes. By designing the screw holes to be elongated, the installation position of the driving motor can be adjusted appropriately, and then the tightness of the driving gear and the rack can be adjusted to optimize the cooperation of the driving mechanisms.

The present invention further provides a stage light including a light source and the beam shading device described above. According to the present invention, the beam shading device partially blocks and intercepts a beam emitted by the light source, so that a stage light can project a light spot in a specific shape.

DETAILED DESCRIPTION OF THE EMBODIMENTS

Figure 1:
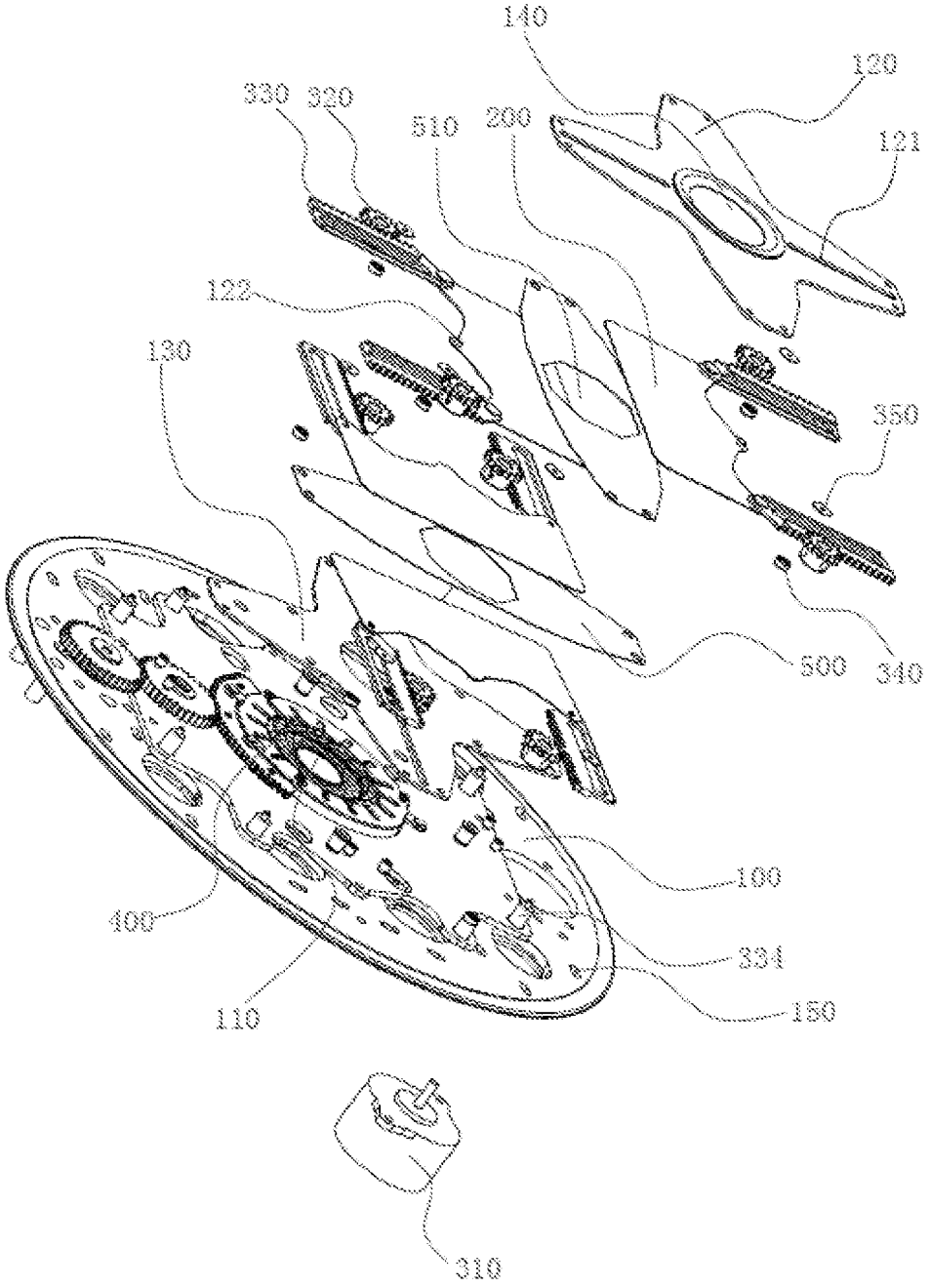
FIG. 1 is an explosive structural diagram of a beam shading device according to one embodiment of the present invention.

The drawings of the present invention are only used for illustrative description, and should not be construed as limiting the present invention. In order to better illustrate the following embodiments, some components in the drawings may be omitted, enlarged or reduced, which does not represent the size of the actual product. For those skilled in the art, it can be understood that some well-known structures in the drawings and their descriptions may be omitted. The positional relations described in the drawings are only for illustrative purposes, and cannot be construed as a limitation of this patent.

Figure 2:
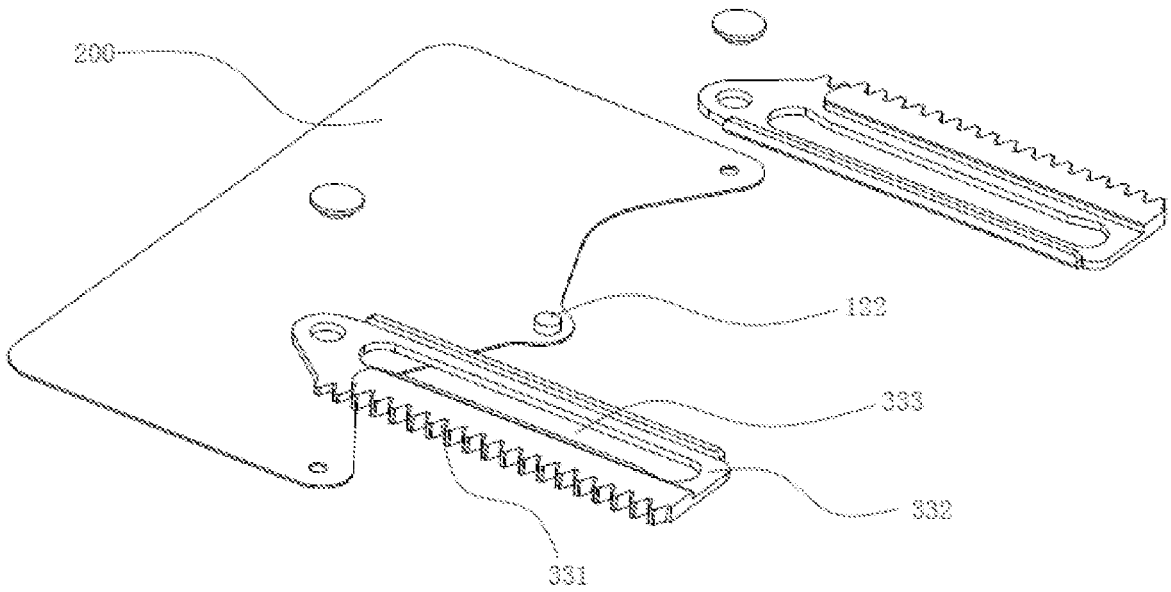
FIG. 2 is an assembly structural diagram when a shading blade and a driving plate is connected according to one embodiment of the present invention.
Figure 3:
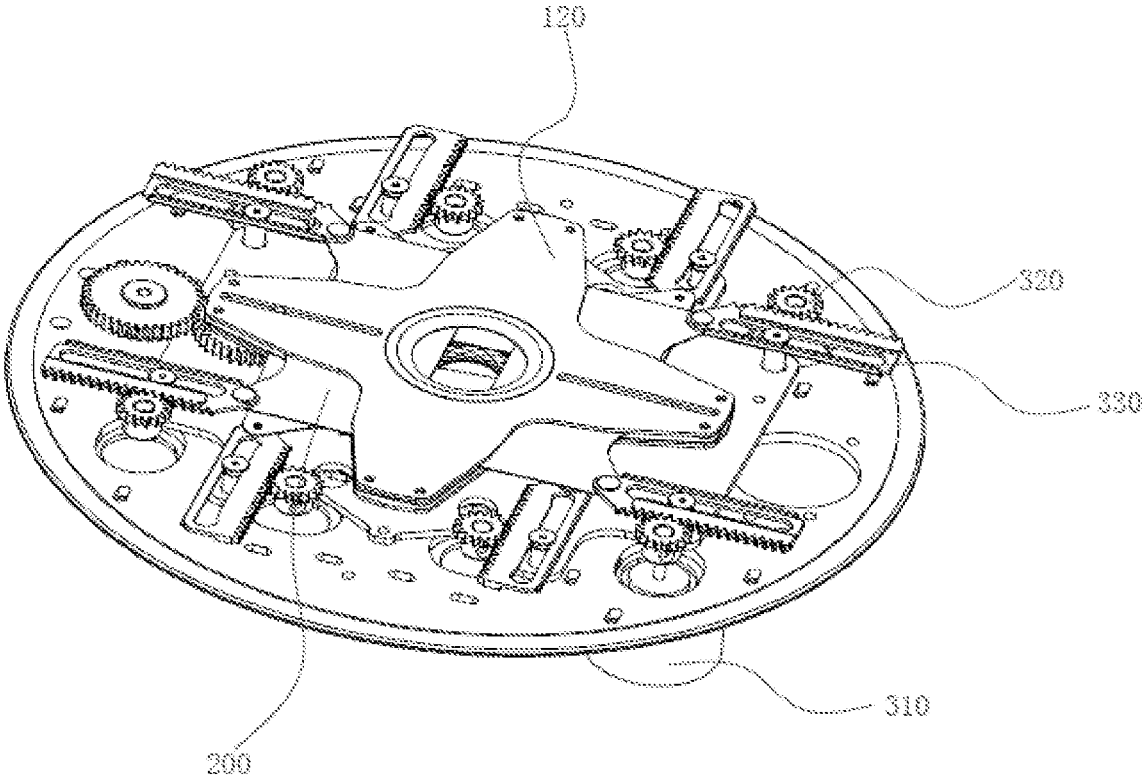
FIG. 3 is an overall structural diagram of the beam shading device according to one embodiment of the present invention.

As shown in FIG. 1 to FIG. 3, according to some embodiments, the beam shading device includes a substrate 100, a plurality of shading blades 200 mounted on the substrate 100, and driving mechanisms for driving the shading blades 200 to move. The substrate 100 is provided with a first light-passing hole 110 through which beams pass. The plurality of shading blades 200 are arranged around the periphery of the first light-passing hole 110. The driving mechanisms drive the shading blades 200 to move back and forth so as to block and open the first light-passing hole 110. Each of the shading blades 200 is configured with at least two driving mechanisms, and each of the driving mechanisms includes a driving gear 320 and a driving plate 330. The driving plate 330 is hinged with the shading blade 200, and the driving plate 330 is provided with a rack 331 meshing with the driving gear 320.

In the embodiments, each shading blade 200 of the beam shading device is configured with at least two driving mechanisms, and each driving mechanism can independently drive the shading blade 200 to move back and forth to block and open the first light-passing hole 110. When two driving mechanisms of each shading blade 200 maintain a motion state consistent, the driving mechanisms drive the shading blade 200 to perform a translation movement. However, when the motion states of the two driving mechanisms of each shading blade 200 are different, since the driving plate 330 is movably connected to the shading blade 200, the driving mechanisms can drive the corresponding shading blade 200 to perform a swing movement. In the present embodiment, a driving motor 310 is used to drive the driving gear 320 to rotate. The specific work process is as follows. When the driving motor 310 is working, a motor shaft thereof rotates to drive the driving gear 320 arranged on the motor shaft to rotate, and the driving gear 320 rotates to drive the driving plate 330 to move, thereby driving the shading blade 200 to perform a translation and/or swing movement to cause the shading blade 200 to reach a preset position and shade the light beams into a preset shape. Driving mechanisms in the present embodiments is configured to be driven by a driving gear 320 and a rack 331 to drive the shading blades 200. Compared with the multi-stage transmission of connecting rods and rocker arms and the soft contact between the belt and the gear in which loose fit is present, it can accurately control the position of the shading blades 200 during the shading process, thus effectively improving the shading accuracy of the shading blades 200 during the shading process, and ensuring the consistency and accuracy of the shading pattern. It should be noted that the shape of the shading edge of the shading blades 200 for beam shading is not limited to a straight line, which can also be any other shape such as an arc or a polygonal line. Accordingly, the overall shape of the shading blades 200 is not limited to only those shown in the drawings.

According to one embodiment, four shading blades 200 are provided, which are arranged in a cross shape around the center of the first light-passing hole 110 with opposite one another in pairs. That is, the connection lines of each pair of opposite shading blades 200 are perpendicular. A spacer 500 is arranged between any two adjacent shading blades 200 to prevent the opposite shading blades 200 from colliding with each other when they move towards each other. Since in this embodiment, two pairs of opposite shading blades 200 are arranged, two spacers 500 are arranged correspondingly, which are respectively provided between the opposite two shading blades 200. Each spacer 500 is also provided with a third light-passing hole 510 communicating with the first light-passing hole 110, and the hole diameter of the third light-passing hole 510 is greater than or equal to the hole diameter of the first light-passing hole 110 to ensure that beams from the first light-passing hole 110 will not be blocked by the spacer 500. The third light-passing hole 510 may be circular or polygonal. Each shading blade 200 moves independently, and performs a preset movement by the driving of the respective driving mechanisms, so as to form a combined light spot effect in any shape. The substrate 100 is also provided with an aperture component 400 for adjusting the size of the first light-passing hole 110. The aperture component 400 is configured to adjust the size of the hole diameter of the first light-passing hole 110, and the shading blades 200 are configured to shade the shape of the light spot. It is thus possible to make the beam effects projected by the stage light more diverse with the combination of the aperture component 400 and the shading blades 200.

Optionally, the rack 331 can be independently fixed to the driving plate 330, or the rack 331 can also be integrated with the driving plate 330, that is, one end of the driving plate 330 is made into a rack shape.

According to a preferred embodiment, the driving plate 330 is provided with a linear first guide groove 333 opened towards the direction of the first light-passing hole 110. The substrate 100 is provided with a first sliding post 334 adapted to the first guide groove 333, The first sliding post 334 penetrates the first guide groove 333 and can slide in the first guide groove 333. The configuration of the first sliding post 334 can support the driving plate 330 on one hand, and can also make the driving plate 330 to move along the first guide groove 333 on the other hand. Preferably, a bearing 340 is sleeved on the first sliding post 334, and by the bearing 340 the first sliding post 334 slides more smoothly in the first guide groove 333. The end of the first sliding post 334 is provided with a gasket 350 that prevents the driving plate 330 from falling off the first sliding post 334. The outer diameter of the gasket 350 is larger than the width of the first guide groove 333. Preferably, the gasket 350 is a bearing gasket and cooperates with the bearing 340 to prevent the bearing 340 from falling off the first guide groove 333.

In a preferred embodiment, the rack 331 and the first guide groove 333 are arranged in parallel each other. The direction of the first guide groove 333 is kept consistent with the direction of the rack 331 so that the driving gear 320 can be continuously driven to move without changing the position of the driving gear 320 during the movement of the driving plate 330. Preferably, the length of the rack 331 is greater than or equal to the length of the first guide groove 333.

In a preferred embodiment, both ends of the first guide groove 333 bend and extend towards the direction of the rack 331. In two of the driving plates 330 provided on the same shading blade 200, when one driving plate 330 moves towards the first light-passing hole 110 and the other driving plate 330 does not move towards the first light-passing hole 110, and the first sliding post 334 is located at an end position of the first guide groove 333, the driving plate 330 that does not move will be caused to rotate around its own first sliding post 334 due to the joint action of the driving plate 330 that moves. The end of the first guide groove 333 bends and extends towards the direction of the rack 331, leaving a smooth rotation space for the first sliding post 334 in the driving plate 330 that does not move, and the corresponding shading blade 200 will not be suddenly jammed.

In a preferred embodiment, the driving gear 320 is made of metal, and the rack 331 is made of rubber. The driving gear 320 and the rack 331 are made of two materials of metal and rubber. Compared with the case where both use metal materials, the use of two materials in which one is soft and the other is hard can reduce the noise generated by the movement of the two. The rubber material has a high elasticity with reversible deformation. When squeezed by the driving gear 320, it can be elastically deformed, so as to adaptively adjust the meshing tightness of the driving gear 320 and the rack 331 and adjust the fitting state of the driving gear 320 and the rack 331, which ensures the shading accuracy of the shading blade 200 during the shading process.

In some other embodiments, the driving gear 320 may also be made of plastic, and the rack 331 may be made of metal, as long as they are made of two different materials in which one is soft and the other is hard.

In a preferred embodiment, the driving plate 330 is provided with a plurality of metal tooth tips at the end close to the shading blade 200 on the side where the rack 331 is provided, which mesh with the driving gear 320. When the driving gear 320 meshes with the metal tooth tips, the shading blade 200 is in the reset state. The shading blade 200 will return to the reset state several times during the shading process. Compared to tooth tips made of rubber, the provision of metal tooth tips at the end of the driving plate 330 close to the shading blade 200 can reduce wear and increase the service life of the driving plate 330. Preferably, there are two metal tips, which are connected to the plastic rack 331 to form a complete rack 331 that meshes with the driving gear 320.

In a preferred embodiment, the two driving plates 330 of each shading blade 200 are arranged on the side of the shading blade 200 far away from the first light-passing hole 110, and the vertical distance between the center of the first light-passing hole 110 and each of the driving plates 330 is equal. That is, each of the shading blades 200 is configured with at least two driving mechanisms, and the two symmetrically arranged sets of the driving mechanisms jointly drive the shading blade 200 to move back and forth to block and open the first light-passing hole 110, and the movement of the shading blade 200 will be more stable. Preferably, the driving plates 330 are provided at the two ends of the shading blade 200 on the side far away from the first light-passing hole 110. It should be noted that this patent is not limited to the case where the vertical distance between the center of the first light-passing hole 110 and each of the driving plates 330 is equal, and the distance can be unequal and it can be selected where the driving plate 3X) is hinged with the shading blade 200 according to actual conditions. The number of the driving mechanisms for driving the same shading blade 200 is not limited to two. That is, the number of the driving plates 330 provided on the same shading blade 200 can be more than two.

In a preferred embodiment, a first panel 120 and a second panel 130 that are in a stacked arrangement are fixed on the substrate 100. Both the first panel 120 and the second panel 130 are separately provided with a second light-passing hole 140 corresponding to the first light-passing hole 110. A plurality of the shading blades 200 are provided between the first panel 120 and the second panel 130. The first panel 120 and the second panel 130 are configured to protect the shading blades 200 and prevent the shading blades 200 from being interfered by other elements during the movement process and being jammed. The first panel 120 and the second panel 130 are both cross-shaped structures, which can protect the shading blades 200 without occupying much space.

In a preferred embodiment, both the first panel 120 and the second panel 130 are provided with a second guide groove 121 corresponding to each of the shading blades 200. The second guide groove 121 is arranged along the radial direction of the first light-passing hole 110, and each of the shading blades 200 is provided with a second sliding post 122 slidingly fitted with the second guide groove 121. The second sliding post 122 can slide in the second guide groove 121, so that the entire shading blade 200 will not deviate, and the shading blade 200 can be guided to move towards or away from the second light-passing hole 140 only. The shading blade 200 may be fitted with the second guide groove 121 of the first panel 120 or the second panel 130 according to whether it is close to the first panel 120 or the second panel 130. In this embodiment, four second guide grooves 121 corresponding to the shading blades 200 are provided. The first panel 120 and the second panel 130 respectively have two opposite second guide grooves 121 which are arranged opposite to each other around the first light-passing hole 110 corresponding to the shading blades 200. The two opposite second guide grooves 121 are parallel to each other and are on the same straight line, and the extension lines of the four second guide grooves 121 intersect at the center of the first light-passing hole 110. Each of the shading blades 200 has a second sliding post 122 that fits with the second guide groove 121.

In a preferred embodiment, screw holes 150 on the substrate 100 for fixing the driving motor 310 is an elongated through hole. By designing the screw holes 150 to be elongated, the installation position of the driving motor 310 can be adjusted appropriately, and then the tightness of the driving gear 320 and the rack 331 can be adjusted to optimize the cooperation of the driving mechanisms. Preferably, the screws for fixing the driving motor 310 are arranged symmetrically around the screw holes 150, and the fixing of the driving motor 310 is relatively stable.

A stage light is further provided according to one embodiment, which includes a light source and the beam shading device described above. The beam shading device partially blocks and intercepts a beam emitted from the light source, so that a stage light projects a beam in a specific shape. The shading device is preferably arranged at the focal position of the light source of the stage light, where the projected light spot is the clearest.

Apparently, the above-mentioned embodiments of the present invention are merely examples for clearly describing the technical solutions of the present invention, and are not intended to limit the specific implementation methods of the present invention. Any modifications, equivalent replacements and improvements made within the spirit and principle of the claims of the present invention shall be included in the protection scope of the claims of the present invention.

The invention claimed is:

1. A beam shading device capable of accurately positioning a plurality of shading blades, comprising:

a substrate, the substrate being provided with a first light-passing hole through which beams pass;

a plurality of shading blades mounted on the substrate, the plurality of shading blades being arranged around a periphery of the first light-passing hole; and driving mechanisms for driving the plurality of shading blades to move, the driving mechanisms driving the shading blades to move back and forth to block and open the first light-passing hole, wherein each of the shading blades is configured with at least two driving mechanisms, each of the driving mechanisms comprises a driving gear and a driving plate, the driving plate is hinged with the shading blade, and the driving plate is provided with a rack that is configured to mesh with the respective driving gear, and wherein when the at least two driving mechanisms maintain a consistent motion state, the respective shading blade is driven to perform a translation movement, and when the at least two driving mechanisms are in different motion states, the respective shading blade is driven to perform a swing movement.

2. The beam shading device according to claim 1, wherein the driving plate is provided with a linear first guide groove elongated along a direction toward the first light-passing hole, the substrate is provided with a first sliding post adapted to the first guide groove, and the first sliding post is disposed within the first guide groove and is slidable in the first guide groove.

3. The beam shading device according to claim 2, wherein the rack is arranged in parallel with the first guide groove.

4. The beam shading device according to claim 2, wherein both ends of the first guide groove bend and extend towards the rack.

5. The beam shading device according to claim 1, wherein the driving gear is made of metal, and the rack is made of rubber.

6. The beam shading device according to claim 5, wherein the driving plate is provided with a plurality of metal tooth tips on a side on which the rack is provided at an end close to the shading blade, which are configured to mesh with the driving gear.

7. The beam shading device according to claim 1, wherein two of the driving plates of each shading blade are arranged on a side of the respective shading blade opposite to the first light-passing hole, and the vertical distance between the center of the first light-passing hole and each of the driving plates is equal.

8. The beam shading device according to claim 1, wherein a first panel and a second panel that are in a stacked arrangement are fixed on the substrate, and both the first panel and the second panel are provided with a second light-passing hole corresponding to the first light-passing hole, and wherein the plurality of the shading blades are provided between the first panel and the second panel.

9. The beam shading device according to claim 8, wherein both the first panel and the second panel are provided with a second guide groove corresponding to each of the shading blades, the second guide groove is arranged along the radial direction of the first light-passing hole, and the respective shading blade is provided with a second sliding post slidingly fitted with the second guide groove.

10. The beam shading device according to claim 1, wherein elongated screw holes are disposed in the substrate for fixing a driving motor.

11. A stage light, comprising a light source and the beam shading device according to claim 1, the beam shading device is configured to partially block and intercept a beam emitted by the light source to project a light spot with a specific shape.

12. The stage light according to claim 11, wherein the substrate is provided with an aperture component for adjusting a size of the first light-passing hole.

13. The stage light according to claim 11, wherein the driving plate is provided with a linear first guide groove elongated along a direction toward the first light-passing hole, the substrate is provided with a first sliding post adapted to the first guide groove, and the first sliding post is disposed within the first guide groove and is slidable in the first guide groove.

14. The stage light according to claim 13, wherein the rack is arranged in parallel with the first guide groove.

15. The stage light according to claim 13, wherein both ends of the first guide groove bend and extend towards the rack.

16. The stage light according to claim 11, wherein two of the driving plates of each shading blade are arranged on a side of the respective shading blade opposite to the first light-passing hole, and the vertical distance between the center of the first light-passing hole and each of the driving plates is equal.

17. The beam shading device according to claim 1, wherein four shading blades are provided, which are arranged in a cross shape around the first light-passing hole and are opposite one another in pairs.

18. The beam shading device according to claim 1, wherein a spacer is arranged between any two adjacent shading blades.

19. The beam shading device according to claim 18, wherein each spacer is provided with a third light-passing hole in communication with the first light-passing hole.

20. The beam shading device according to claim 19, wherein a diameter of the third light-passing hole is greater than or equal to a diameter of the first light-passing hole.

* * * * *